United States Patent [19]

Stewart

[11] Patent Number: 4,945,585

[45] Date of Patent: Aug. 7, 1990

[54] BED WITH ROTATABLE ROLLERS

[76] Inventor: John V. Stewart, 1308 Henry Balch Dr., Orlando, Fla. 32810

[21] Appl. No.: 215,254

[22] Filed: Jul. 5, 1988

[51] Int. Cl.[5] ..... A47C 17/04; A45F 3/22

[52] U.S. Cl. ..... 5/122; 5/61; 5/12.1

[58] Field of Search ..... 5/61, 12 R, 81 C, 122, 5/120, 88; 297/457

[56] References Cited

U.S. PATENT DOCUMENTS

| | | | |
|---|---|---|---|
| 4,109,329 | 8/1978 | Tupper | 5/61 |
| 4,270,234 | 6/1981 | James | 5/61 |
| 4,357,722 | 11/1982 | Thompson | 5/61 |
| 4,459,712 | 7/1984 | Patman | 5/81 C |
| 4,825,483 | 5/1989 | Nassar | 5/12 R |

FOREIGN PATENT DOCUMENTS

| | | | |
|---|---|---|---|
| 293819 | 8/1916 | Fed. Rep. of Germany | 5/88 |

*Primary Examiner*—Alexander Grosz

[57] ABSTRACT

A flexible tube of fabric (1) is supported by a plurality of parallel shafts (3) arranged in the tube's interior, such that a sling of fabric is suspended toward the center of the tube between two of the shafts. The shafts, or cylindrical rollers journaled thereon, rotate freely, allowing the tube to rotate. A person reclining in the sling of fabric obtains uniform body support and can easily turn over. Shaft rotation can be braked for convenient entry/exit of the occupant, with brakes designed to automatically disengage when the occupant is in the sling. The shape of the fabric tube can be varied to provide contoured body support.

10 Claims, 6 Drawing Sheets

BED WITH ROTATABLE ROLLERS

BACKGROUND—FIELD OF INVENTION

This invention relates to furniture for supporting the reclining human body, including beds and lounges.

BACKGROUND—DESCRIPTION OF PRIOR ART

The art of furniture design uses various means to support the human body. Unfortunately, none are optimum, so existing furniture tends to be uncomfortable in prolonged use. An inherent disadvantage in existing furniture is the limited surface area which can contact a supported body, resulting in pressure zones, rather than uniform support. The only way to entirely avoid this problem is to suspend the body by floatation in a fluid such as water.

The waterbed is an attempt to provide such flotation support. However, current embodiments provide support mainly by the surface tension of a water bag, rather than by flotation. This is little or no improvement over an air mattress, yet a waterbed weighs as much as a small car. There are practical reasons for this result. In order to achieve true flotation, a body must sink into a fluid, requiring a deeper water mattress than those currently available. A filled king size waterbed mattress of the current variety weighs about 1 ton, so a mattress twice as deep would weight about 2 tons, becoming less practical. Even if a deep mattress were practical, other disadvantages would arise—a large percentage of the body would be in contact with the wrinkled, non-breathing film of the mattress bag, and there would be more water to heat.

Another support technique, using a sling of fabric, is variously employed in the cot, the hammock, and traction devices used in medicine. All of these achieve limited success for specialized uses, but none have the combination of comfort, practicality, and flexibility required for widespread use in household furniture. The cot is not especially comfortable, due to its tight, unyielding fabric and hard rails. The hammock is quite comfortable in some ways, providing uniform lateral support and breathability, but it sags into longitudinal curvature. Traction devices restrict movement, and do not offer ease of entry and exit. These are just a few of the disadvantages of existing devices of this type.

The air mattress provides fairly uniform support if low inflation pressure is used, but low inflation allows the hips to sink, and increases skin contact by the non-breathable mattress film. High inflation reduces uniformity of support. Air mattresses are of relatively low durability, and tend to leak. These disadvantages also apply to waterbed mattresses.

OBJECTS AND ADVANTAGES

The object of this invention is improvement in the comfort of furniture used for reclining, without sacrificing practicality in its manufacture and use. In other words, the object is to achieve uniform body support, without the disadvantages seen in many prior attempts.

This invention can provide more uniform support than waterbeds or air mattresses, due to its greater practical depth and its contour fitting capability. It offers the type of comfortable support found in a hammock, without the hammock's longitudinal sag. It can be built in sections for independent suspension of torso and legs. It offers design flexibility, allowing use in chairs and lounges as well as beds. It is light weight and easy to clean. It allows body rotation, produces no lateral tension against the body, and allows the skin to breathe. It is practical to manufacture.

DRAWING FIGURES

FIG. 1—A bed embodiment of the invention
FIG. 2—End view of bed
FIG. 3—Upper and lower fabric support members
FIG. 4—Alternate configuration of invention, end view
FIG. 5—Another alternate configuration, as a water lounge
FIG. 6—Section view of bed embodiment with contour adjuster
FIG. 7—Detail of contour adjustment rollers
FIG. 8—Contour adjustment actuator
FIG. 9—Fabric support members with adjustable tension cable
FIG. 10—Brake for upper fabric support cylinder, side view
FIG. 11—Brake, viewed from end of bed, section of FIG. 10
FIG. 12—Detail of fabric tension sensor of FIG. 10
FIG. 13—Detail of brake lever and spring of FIG. 11
FIG. 14—Alternate version of brake for fabric support cylinder, side view
FIG. 15—Brake viewed from end of bed, section of FIG. 14
FIG. 16—Detail of lower brake cable and pulley of FIG. 14
FIG. 17—Detail of fabric tension sensor and lower brake cable of FIG. 15

DRAWING REFERENCE NUMERALS

1 Flexible tube
2 Seam
3 Fabric support shaft
4 Structural framework
5 Bottom plate
6 Rotatable cylinder
7 Bearing rod of fabric support shaft
8 Spar
9 Brace
10 Water level when invention used as wet lounge
12 Attached cushion
14 Fabric sling
15 Lower fabric span
16 Pillow
18 Contour adjustment rollers
20 Retainer ring
22 Hinge joint
24 Segmented bearing rod of contour adjuster
26 Bearing sleeve
28 Adjuster arm
30 Adjusted fabric path
32 Push rod lock
34 Push rod
36 Rod guide
40 Fulcrum of adjustment arm
42 Tension cable
44 Pass-through aperture
45 Trussed brace
46 Bearing aperture
48 Cable angle
50 Cable guide pulley
52 Cable drum and ratchet 54 Ratchet latch
59 Brake shoe
60 Brake lever
61 Brake spring
62 Brake disengagement cable
64 Fabric tension sensor
66 Pulley
68 Slot

DESCRIPTION

As shown in FIGS. 1 and 2, a tube of fabric is supported horizontally by two or more parallel shafts (3) inserted through the tube so that the upper half of the tube hangs between two of the shafts as a sling (14). The shafts have low friction means, allowing the fabric tube to rotate. This can be achieved by cylinders which rotate upon bearing rods 7, as in FIG. 3, or by mounting the shafts on bearings.

The shape of the fabric tube can be varied via an adjustable seam (2), by varying the curvature or shape of the shafts (3), or by a fabric span deflection mechanism. This mechanism can consist of a row of cylindrical rollers (18) mounted end-to-end on a segmented bearing rod (24), as in FIGS. 6 and 7. The rollers press upon a lower span of the fabric tube (15), displacing that span and thus a corresponding area of the upper span. A series of support arms (28), connected to rod 24 between each roller (18), holds rod 24 in the desired shape. Actuators control the positions of these arms—FIGS. 7 and 8. This mechanism can be positioned underneath the bed, with an adjustment lock (32) reachable from beside the bed.

FIG. 1 is a perspective view of a basic bed embodiment of the invention. Four horizontal shafts (3) support fabric tube 1 in sling, in which a person may recline. The fabric tube can be constructed by temporary connection of two opposing edges of a sheet of fabric along a seam (2). This allows the fabric to be easily removed for cleaning. Provision can be made for adjusting the diameter of the tube, and for constricting portions of the tube in varying amounts. This allows for stretching of the fabric, customization of the fabric contour, and accomodation of different preferences in fabric tension. The most convenient way to accomplish this might be a quick-connect material sewn to an area along the two fabric edges. Other possibilities include laces or zippers. Seam 2 can be rolled to the underside of the bed during use.

FIG. 2 is an end view of FIG. 1. Bottom plate 5 prevents the bottom fabric span (15) from drooping to the floor when the bed is unoccupied. This helps prevent the fabric sling (14) from rising when the bed is unoccupied, due to slack fabric elsewhere. The plate should be as close as possible to the lower fabric span without touching the fabric. The bottom plate prevents the fabric from becoming soiled on the floor, and opposes inward force exerted by fabric support shafts 3 on the structural framework 4.

For the sake of clarity, oblique trusses between the vertical and horizontal structural members 4 are not shown. Trusses should be small enough to allow entry and seating at the end of the bed.

FIG. 3 is a suggested construction for the upper and lower fabric support shafts (3) on one side of a four-shaft embodiment, such as FIG. 1. Each shaft includes a series of rotatable cylinders (6) journaled on a central rod 7. The rod is supported from a spar 8 at intervals, via braces 9. This provides lateral rotation and longitudinal rigidity. The upper shafts carry the weight of the occupant, and the lower shafts carry a moderate upward force component. In the suggested construction of FIG. 3, these opposing forces meet in the spar 8, reducing its required mass. Braces 9 can be of adjustable length, and/or varying length—slightly longer toward the middle for the upper braces, and shorter toward the middle for the lower braces, to compensate for spar bowing. This further reduces the mass required in the spar to hold the shafts straight under load, which is desirable.

Another technique, as shown in FIG. 9, is to provide a tension cable (42) under spar 8, passing through the lower braces (9, 45) in a curved path, lowest at the middle of the spar. Tightening this cable exerts upward force on the middle of the spar, helping to support the occupant's weight.

The simplest technique to compensate for bowing of the support shafts (3) is to constrict the fabric tube (1) toward its middle. The degree of constriction can be adjusted for different contour preferences and body weights.

The lower shafts (3) in a four-shaft embodiment, carry both upward and inward components of force. The inward force exerted on structural members 4 is opposed by bottom plate 5, as seen in FIG. 2, and/or by trusses (not shown). Inward bowing of the lower shafts can also be opposed by horizontal braces between these shafts. This is shown as the horizontal part of brace 9 in FIG. 11.

FIG. 4 is an end view of a three-shaft embodiment, less the structural framework.

FIG. 5 is an end view of a two-shaft embodiment used as a water lounge. A soft outer layer on cylinder 6 is used here for flotation. It can be plastic foam or inflatable plastic.

FIG. 6 is a section view of a bed embodiment, limited to the fabric tube 1, with contour adjustment rollers 18 underneath. These rollers can push against the lower fabric span 15 to displace it varying amounts. Each displacement is reflected in the sling (14), customizing its profile. In FIG. 6, displacement at 15 produces a corresponding displacement at 14, which is for lumbar support. This profile remains the same when the user turns over. A different approach is used where the desired profile changes with body rotation. Cushion 12 attached to the fabric, will rotate with the fabric when the user turns over. This moves the cushion aside, allowing the legs to lie straight. A detached head pillow 16 can be used. It will cradle the head, since its sides will be raised. It can be tapered from center to ends to eliminate the cradle, which is better for sleeping on side or stomach. It can also be attached to the fabric tube, and contoured to provide an appropriate surface for each body rotation. Alternately, head support can be provided by the fabric profile.

Contour adjustment can be done by other means, as discussed regarding FIG. 1, however, the mechanism of FIGS. 6–8 provides added convenience.

FIG. 7 is a detail view of two segments of the contour adjustment mechanism of FIG. 6. Plastic is the suggested material for the cylinders 18, with steel for bearing rod 24. Each segment of the bearing rod is hinged to its neighbor via a joint (22). Curvature of the row of segments is determined by the positions of adjustable arms 28, which support the bearing rod at its hinge points.

FIG. 8 is a contour adjustment actuator. It can be located under the bed, with adjustable lock 32 accessable at the side of the bed.

FIG. 9 is a section view of upper and lower fabric support shafts 3 with an adjustable tension cable 42. Such a cable provides upward support along spar 8 to prevent sagging of the shafts under the weight of an occupant. Cable adjustment is via a drum and latch in this illustration.

Spar 8 provides rigidity in this assembly. Some upward force is contributed by lower shaft 3 from fabric tension. Thus, cable 42 need only provide supplementary force to maintain straightness of the assembly. Extra strength is needed when a person sits on the upper fabric support. A formula for the required cable capacity is offered, using the following variables:

MF=Maximum upward force required by the cable at its midpoint

A=Cable angle from the horizontal (48)

TS=Tensile strength required of cable $$TS=MF/(2 \sin A)$$

For example, to exert an upward force of 100 lbs with a cable angle of 10 degrees, the cable tension required is 288 lbs. This amount of supplemental force is sufficient for a 300 lb occupant at rest in the fabric sling, since the cables alone, one on each side, will support 200 pounds. However, to allow for the stress when a person moves, or when sitting on upper shaft 3, a cable strength of about 1000 lbs is recommended. This depends on the angle of the cable and the rigidity of the spar. No cable is needed if the spar is very rigid and/or other means for opposing sagging are used, such as previously described.

In lieu of cable, tension rods can be used. These follow a similar path, and are threaded on at least one end for adjustability.

FIG. 10 is a side view of part of fabric support assembly. The object of this drawing is to show the location of a brake which can be used to control upper cylinder rotation. A brake lever 60 is connected to brace 9, and presses a shoe against two adjacent cylinders on an upper fabric support shaft. When the brake is engaged, cylinder rotation is hindered. This is desirable during a user's entry and exit of a bed embodiment, and for sitting on upper fabric support shaft 3. Further details of this version of the brake are shown in FIGS. 11–13.

FIG. 11 is a section view from the end of a bed embodiment, through brace 9, showing the braking device of FIG. 10 from a different angle. A horizontal extension of brace 9 is shown. This is connected between the two lower fabric support shafts (3) for additional rigidity, preventing inward bowing of these shafts. Fabric tension sensor 64 is lifted by fabric tension when the sling is occupied. This disengages the brake via tension on brake cable 62. Otherwise the brake is engaged due to spring 61, which is shown in the detail view of FIG. 13.

FIG. 12 is a detail view of the lower part of FIG. 10, showing the fabric tension sensor from that figure with better clarity. The sensor is a lever, connected between two cylinders of a lower fabric support shaft (3). It extends inward over lower fabric span 15. Brake cable 62 is connected to this lever opposite the extension, such that the cable is tensioned when the lever extension is raised.

FIG. 13 is a detail view of brake lever 60 of FIG. 11, showing brake shoe 59 and brake spring 61. The lever straddles a brace 9, and is connected to it by a hinge pin. The pin extends beyond the sides of the lever to retain the spring. The spring straddles the brace to provide even force to both sides of the brake lever.

FIG. 14 begins a series of 4 figures, 14 through 17, which show a second option for sensing fabric tension to disengage the brake.

FIG. 15 is a section view from the end of a bed embodiment, through brace 9, showing the braking device of FIG. 14 from a different angle. Here the tension sensor utilizes the lower fabric support shaft (3), which moves inward via slot 68 in response to fabric tension. Brake cable 62 is connected to bearing rod 7 of lower fabric support shaft, and, via pulley 66, to the brake lever. Fabric tension pulls rod 7 inward, tensioning the cable, thus disengaging the brake. An advantage of this sensor mechanism over the lever type of FIGS. 11–13 is that it does not interfere with contour adjustment rollers 18.

PREFERRED EMBODIMENT

Figure 1:
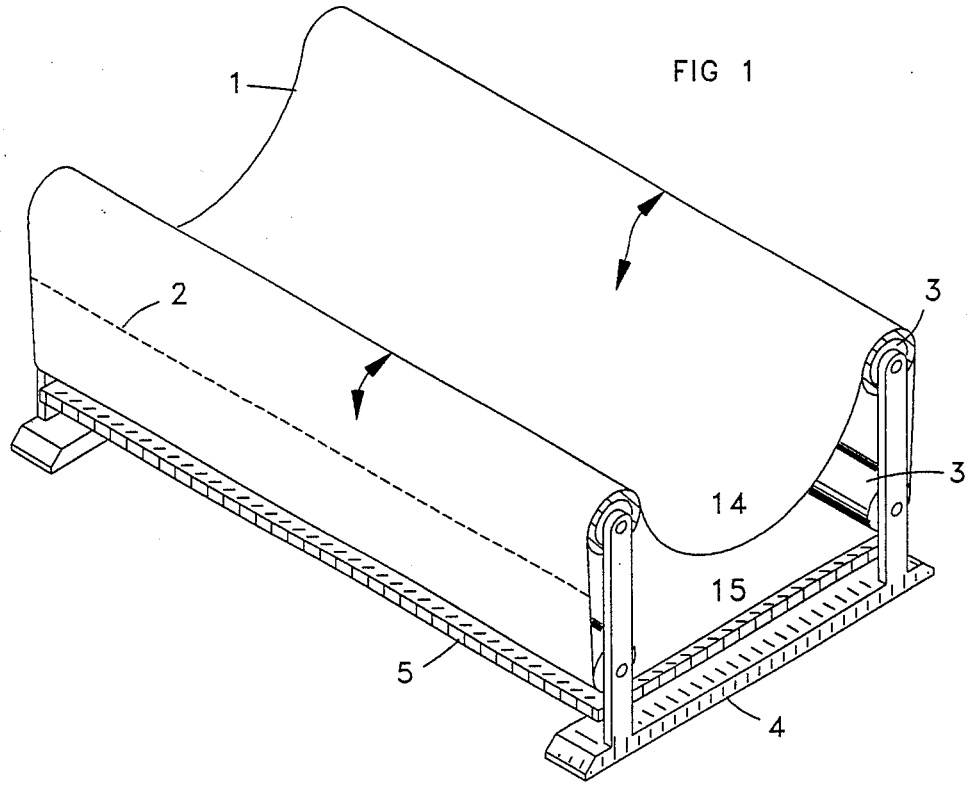
Figure 2:
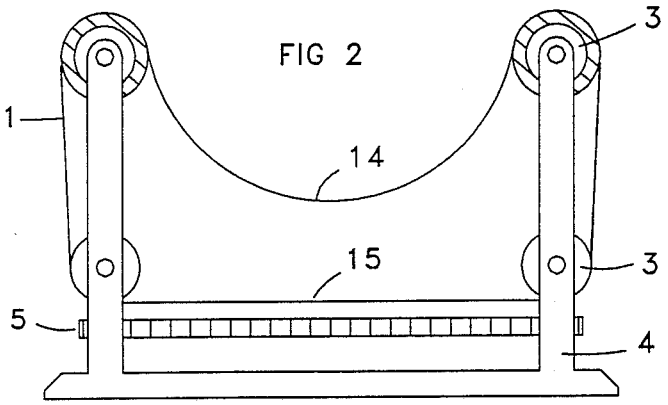
Figure 3:
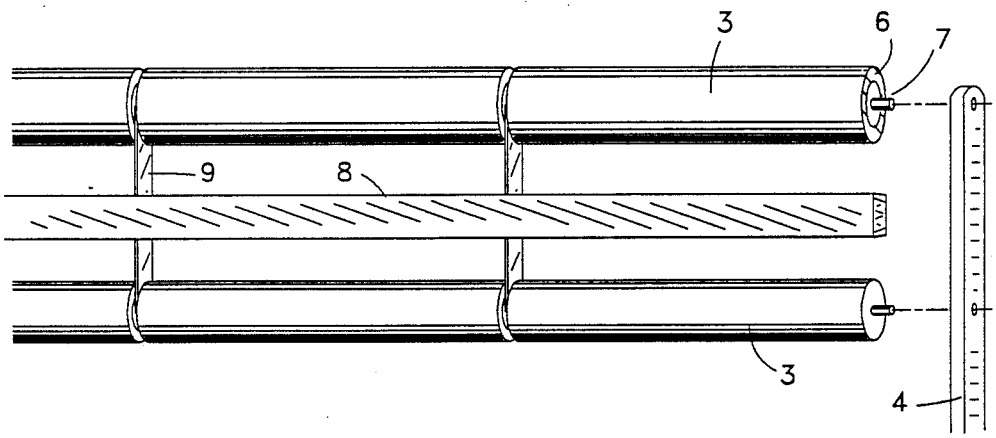
Figure 4:
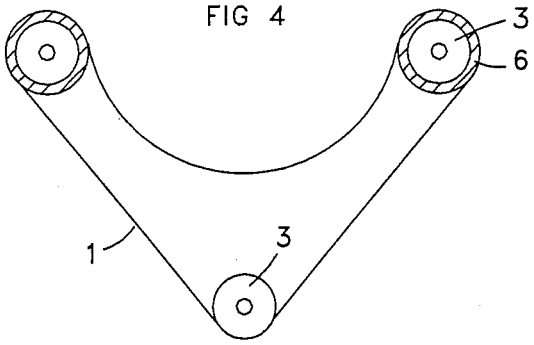
Figure 5:
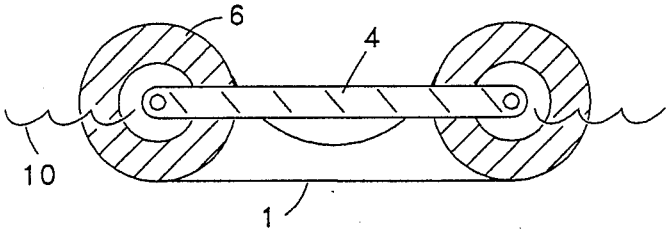
Figure 6:
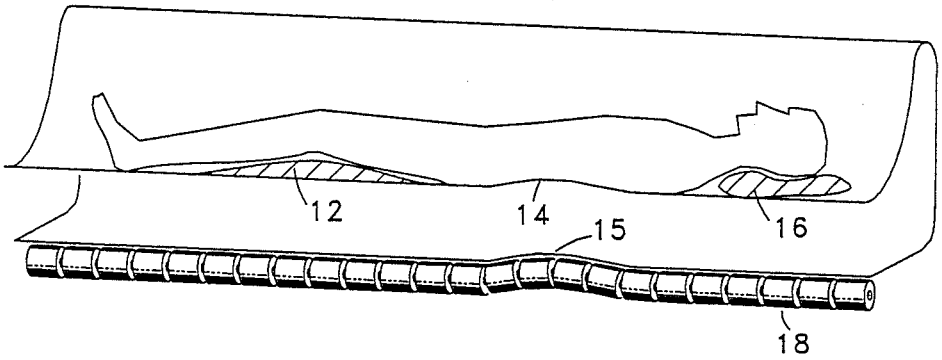
Figure 7:
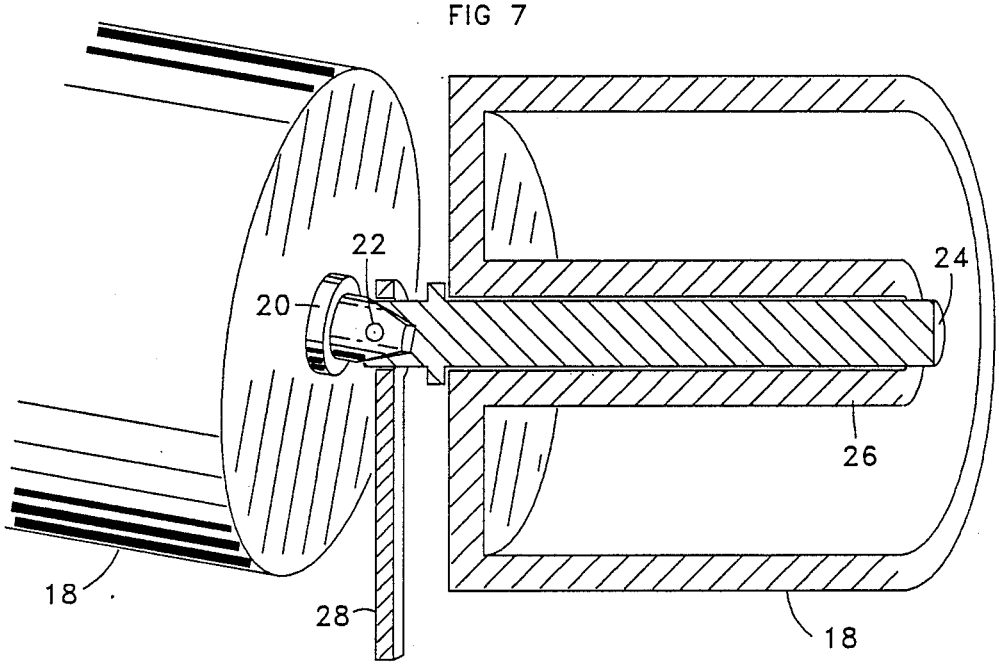
Figure 8:
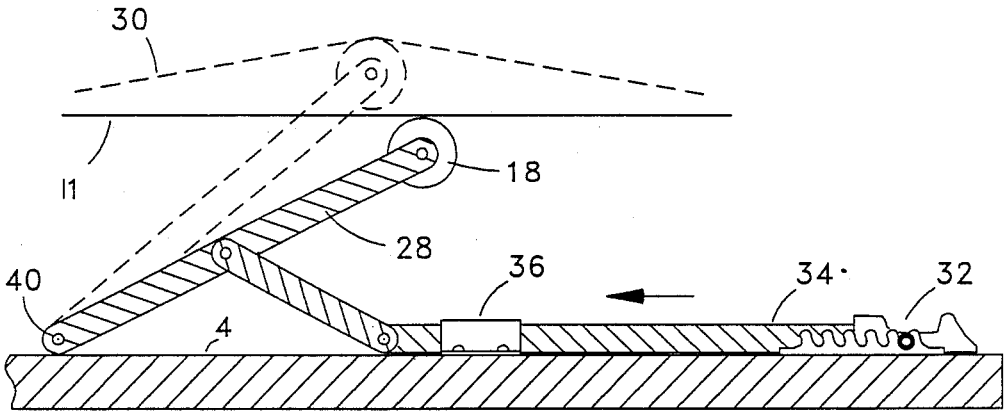
Figure 9:
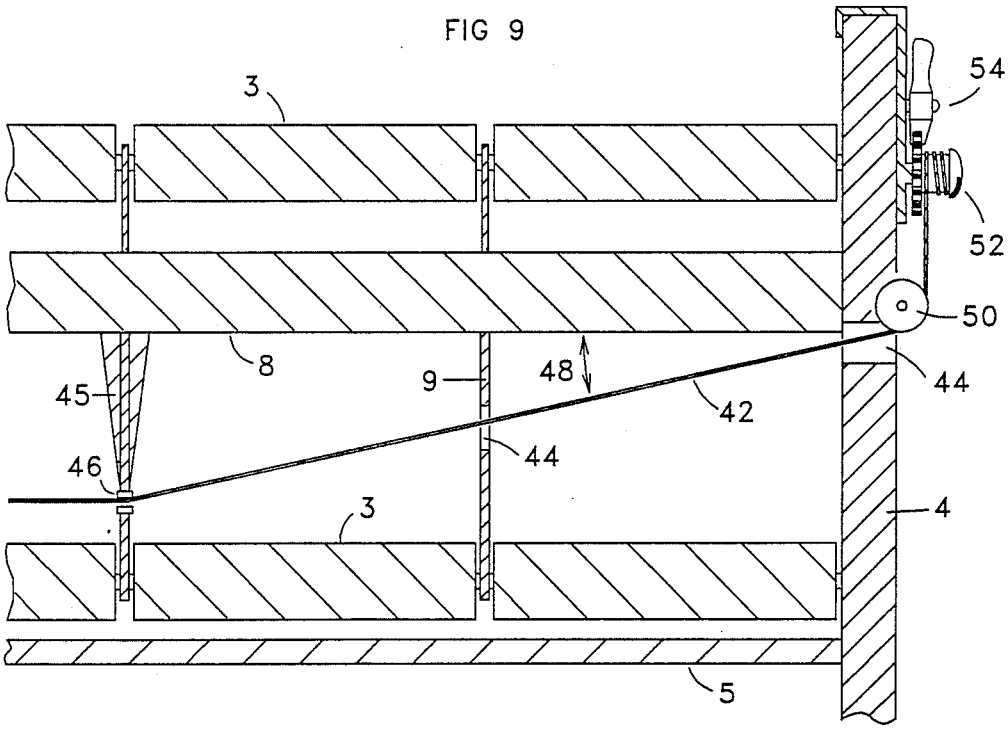
Figure 10:
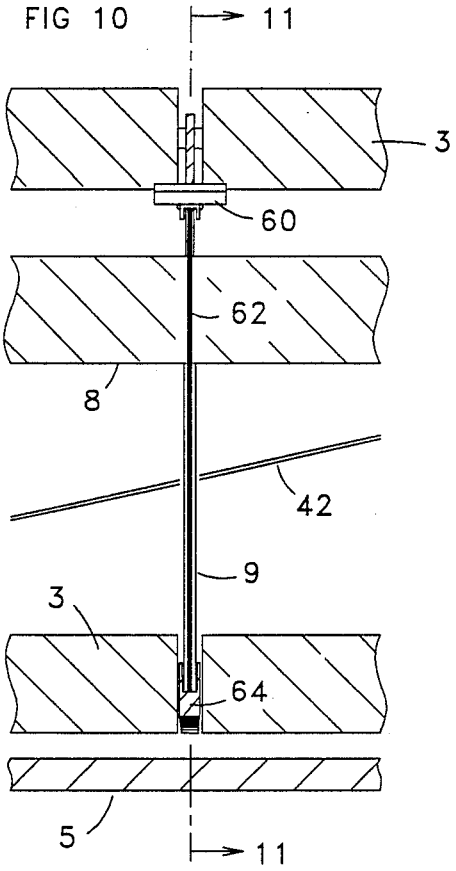
Figure 11:
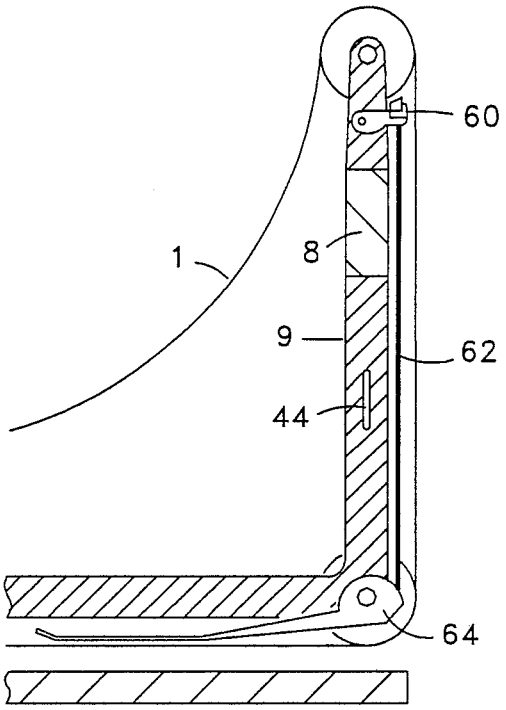
Figure 12:
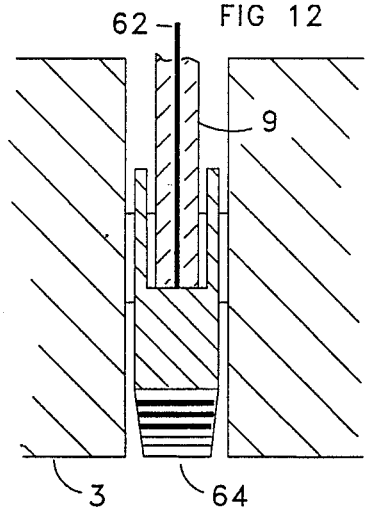
Figure 13:
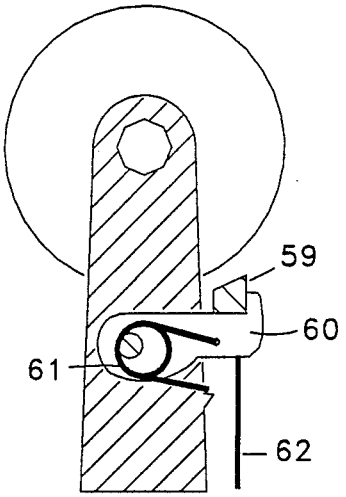
Figure 14:
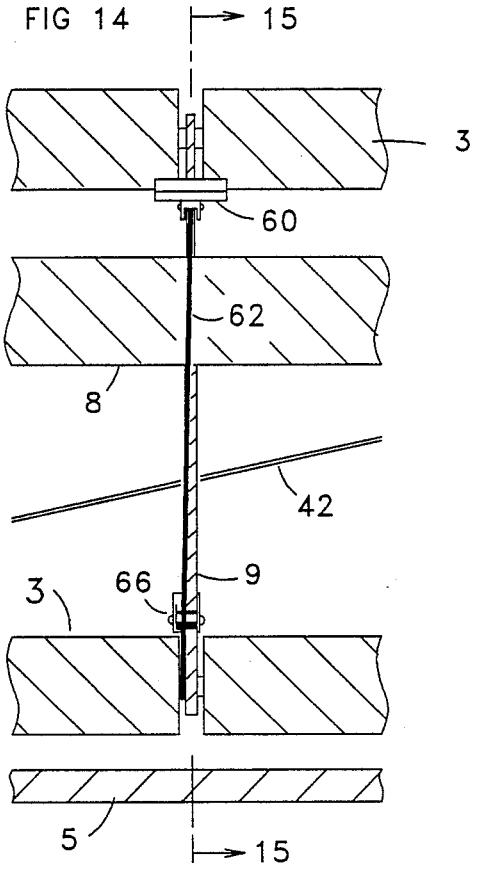
Figure 15:
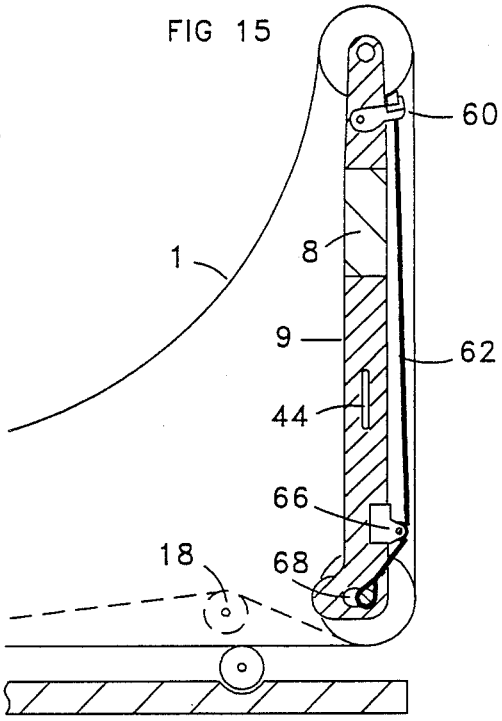
Figure 16:
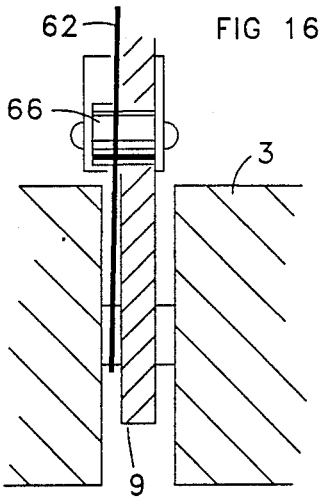
FIG. 16 is a detail view of the lower part of FIG. 14, clarifying lower brake cable 62 and pulley 66.
Figure 17:
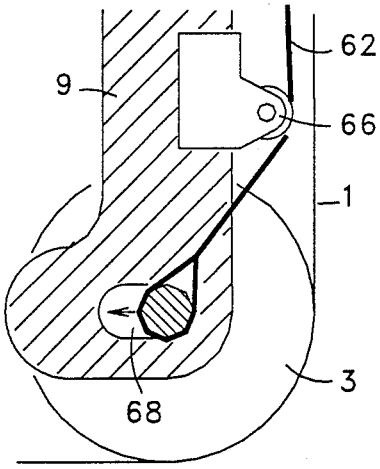
FIG. 17 is a detail view of the lower part of FIG. 15, showing slot 68 which allows the central rod of the lower fabric support to shift inward, tensiong brake cable 62.

A bed with four fabric support shafts (3), using steel bearing rods (7) and plastic cylinders (6). A rigid spar (8) is connected between each pair of upper and lower shafts via braces (9). An adjustable steel tension cable (42) is used under each spar. Automatic brakes are used on the upper cylinders as in FIGS. 14–17. Sling contour is adjustable via the fabric tube seam (2).

SUMMARY AND OPERATION

The invention creates a trough-shaped fabric sling in which a person reclines. It may be embodied to support parts of the body independently. For example, in a lounge chair embodiment, each leg can have a separate sling. The sling passively rotates laterally. This relieves all lateral stress on the supported body or limb. In the case of a bed embodiment, it also allows the user to easily turn over. Cushions attached to the fabric will rotate into, or out of, position by body rotation during use. This provides a variety of available support profiles, appropriate for each side of the body.

The contour of the fabric sling can be adjusted to raise specific areas by one or more of the following means:

1. adjust the seam which forms the fabric tube
2. contour or curve the fabric support shafts
3. deflect the lower fabric span in specific areas For ease of entry into the bed embodiment, the rolling cylinders of the upper fabric support shafts are braked to temporarily prevent rotation. The brake can be activated manually and/or automatically. The automatic embodiment unlocks the cylinders when the fabric is tensioned by the weight of an occupant. Disengagement force can be obtained from tension in the lower span of fabric. The brake remains engaged when a person sits on the upper fabric support shaft, which is desirable.

NUMERALS IN CLAIMS

Drawing elements identification numerals in the claims are used to clarify the claims by reference to examples in the drawings. The elements as drawn are to be taken as examples for clarifying the claims, not as limitations.

I claim:

1. A furniture device adapted to support a reclining user, comprising:

a generally horizontal tube of flexible material (1);

a plurality of elongated shafts (3) inserted through and supporting said tube at intervals around its circumference;

said material forming a sling between two uppermost shafts; and low friction means for allowing said tube to passively and freely rotate laterally around said shafts without using mechanical drive means with said shafts;

whereby a person can recline in the sling, and can easily turn over.

2. The device of claim 1, wherein said shafts comprises a plurality of rotatable cylinders (6) journaled upon a bearing rod (7).

3. The device of claim 2, further including a brace (9) connected at one end to the bearing rod between two of said cylinders, and connected similarly at a second end to a second said shaft (3).

4. The device of claim 2, further including an elongated rigid spar (8) inserted through said tube, and a brace (9) connected at one end to the bearing rod between two of said cylinders, and connected at a second end to said spar (8).

5. The device of claim 4, further including tensioning means for applying force substantially perpendicularly toward said spar, including an elongated tension member (42) having two ends connected near the ends of said spar, said tension member curving generally away from said spar at its midpoint, and means for adjusting the tension of said tension member.

6. The device of claim 2, further including means for braking the rotation of said cylinders, including means for disengagement of said braking means.

7. The device of claim 6, further including means for transferring force from tension in said flexible material caused by the weight of an occupant in the sling, to activate said brake disengagement means, whereby the presence of an occupant in the sling causes disengagement of the brake means.

8. The device of claim 1, further including means for adjusting the shape of said sling to provide a desirable support contour for said person.

9. The device of claim 8, wherein said adjustment means comprises an adjustable seam (2) joining and forming said material into said tube in a variable shape.

10. The device of claim 8, wherein said adjustment means comprises: a plurality of rollers (18) journaled upon a segmented bearing rod (24); said segmented rod having a plurality of hinged joints (22);

a plurality of adjustable arms (28) each connected at one end to said segmented rod (24) near one of said joints (22);

said adjustable arms holding said segmented shaft in a shape and position that urges some of said rollers against a span of said flexible material, displacing said span to a degree dependent on the position of said arms.

* * * * *